US010490885B2

(12) United States Patent
Lee et al.

(10) Patent No.: US 10,490,885 B2
(45) Date of Patent: Nov. 26, 2019

(54) ANTENNA DEVICE AND ELECTRONIC APPARATUS

(71) Applicant: E Ink Holdings Inc., Hsinchu (TW)

(72) Inventors: Yu-Ming Lee, Hsinchu (TW); Chuen-Jen Liu, Hsinchu (TW)

(73) Assignee: E Ink Holdings Inc., Hsinchu (TW)

( * ) Notice: Subject to any disclaimer, the term of this patent is extended or adjusted under 35 U.S.C. 154(b) by 0 days.

(21) Appl. No.: 15/904,448

(22) Filed: Feb. 26, 2018

(65) Prior Publication Data

US 2019/0058246 A1 Feb. 21, 2019

(30) Foreign Application Priority Data

Aug. 17, 2017 (CN) ..... 2017 1 0705390

(51) Int. Cl.

| | |
|---|---|
| ***H01Q 1/24*** | (2006.01) |
| ***H01Q 5/30*** | (2015.01) |
| ***H01Q 13/10*** | (2006.01) |
| ***H01Q 9/04*** | (2006.01) |
| ***H01Q 9/42*** | (2006.01) |
| ***H01Q 5/364*** | (2015.01) |

(52) U.S. Cl.

CPC ..... *H01Q 1/248* (2013.01); *H01Q 5/30* (2015.01); *H01Q 5/364* (2015.01); *H01Q 9/0457* (2013.01); *H01Q 9/42* (2013.01); *H01Q 13/10* (2013.01)

(58) Field of Classification Search

None

See application file for complete search history.

(56) References Cited

U.S. PATENT DOCUMENTS

| | | | | |
|---|---|---|---|---|
| 8,717,240 | B2 * | 5/2014 | Flores-Cuadras | H01Q 1/243 343/702 |
| 9,864,882 | B1 * | 1/2018 | Geist | G06K 7/10158 |
| 2009/0256763 | A1 * | 10/2009 | Chi | H01Q 7/00 343/741 |

FOREIGN PATENT DOCUMENTS

| | | |
|---|---|---|
| TW | I425708 | 2/2014 |
| TW | M472962 | 2/2014 |
| TW | M537728 | 3/2017 |

OTHER PUBLICATIONS

Office Action of Taiwan Counterpart Application, dated Nov. 30, 2018, pp. 1-5.

* cited by examiner

*Primary Examiner* — Howard Williams
(74) *Attorney, Agent, or Firm* — JCIPRNET

(57) ABSTRACT

An antenna device including an antenna radiator and a feed line layer is provided. The antenna radiator is disposed on a first surface of a detachable substrate. The antenna radiator receives a microwave signal of at least one frequency band. The feed line layer is disposed on a second surface of a control circuit board. The feed line layer includes a signal feed line. The signal feed line is coupled to the antenna radiator through a connection point. The connection point is located on one side of the control circuit board. The detachable substrate and the control circuit board are arranged to have an angle between the first surface and the second surface. In addition, an electronic apparatus is also provided.

10 Claims, 4 Drawing Sheets

ANTENNA DEVICE AND ELECTRONIC APPARATUS

CROSS-REFERENCE TO RELATED APPLICATION

This application claims the priority benefit of China application serial no. 201710705390.6, filed on Aug. 17, 2017. The entirety of the above-mentioned patent application is hereby incorporated by reference herein and made a part of this specification.

BACKGROUND OF THE INVENTION

1. Field of the Invention

The invention relates to a microwave signal harvesting technology. More particularly, the invention relates to an antenna device and an electronic apparatus.

2. Description of Related Art

With the development of wireless charging technology, more and more electronic equipment is equipped with a charging antenna, so as to receive a microwave signal through wireless transmission. Nevertheless, shell materials, circuit substrates, and panels may generate a shielding effect on the microwave signal, the charging antenna thus experiences poor microwave signal reception, and a wireless charging effect is thereby affected. Moreover, the general charging antenna is only suitable for receiving a microwave signal of a single frequency band, and if the charging antenna is intended to be operated in a plurality of charging frequency bands, the structural design of the charging antenna may become complicated. As such, how the antenna device is designed to be operated in multiple frequency bands and to provide anti-shielding effect capability such that the antenna device is able to effectively receive the microwave signal is thus an important issue. Therefore, solutions are provided in the following embodiments of the invention.

SUMMARY OF THE INVENTION

The invention provides an antenna device and an electronic apparatus which may effectively receive a microwave signal of at least one frequency band and are capable of performing anti-shielding.

An antenna device provided by an embodiment of the invention includes an antenna radiator and a feed line layer. The antenna radiator is configured to receive a microwave signal of at least one frequency band and is disposed on a first surface of a detachable substrate. The feed line layer includes a signal feed line and is disposed on a second surface of a control circuit board. The signal feed line is coupled to the antenna radiator through a connection point, and the connection point is located on one side of the control circuit board. The detachable substrate and the control circuit board are arranged to have an angle between the first surface and the second surface.

In an embodiment of the invention, the angle is 90 degrees.

In an embodiment of the invention, at least one of the detachable substrate and the control circuit board is a flexible substrate.

In an embodiment of the invention, a first length of the antenna radiator is determined by a half-wave length of the at least one frequency band.

In an embodiment of the invention, the antenna radiator is adapted to be at least operated in a first frequency band, a second frequency band, and a third frequency band. A first length of the antenna radiator is a sum of respective half-wave lengths of the first frequency band, the second frequency band, and the third frequency band. The first frequency band, the second frequency band, and the third frequency band are 900 MHz, 1800 MHz, and 2.4 GHz respectively.

In an embodiment of the invention, the signal feed line is disposed in a slot structure of the feed line layer.

In an embodiment of the invention, the signal feed line has 50 ohm impedance matching. A second length of the signal feed line is determined according to a thickness of the feed line layer.

In an embodiment of the invention, the antenna device further includes an energy harvesting module. The energy harvesting module is configured to receive the microwave signal and is disposed on the control circuit board. The energy harvesting module includes a filter circuit and a rectifier circuit. The filter circuit is configured to receive the microwave signal. The rectifier circuit is configured to convert the microwave signal passing through the filter circuit into a direct current signal and is coupled to the filter circuit.

In an embodiment of the invention, a reflection coefficient of the filter circuit in the at least one frequency band is less than −20 dB.

An electronic apparatus provided by an embodiment of the invention includes an antenna device, an energy harvesting module, an energy storage module, a power supply module, and a display panel. The antenna device includes an antenna radiator and a feed line layer. The antenna radiator is configured to receive a microwave signal of at least one frequency band and is disposed on a first surface of a detachable substrate. The feed line layer includes a signal feed line and is disposed on a second surface of a control circuit board. The signal feed line is coupled to the antenna radiator through a connection point. The connection point is located on one side of the control circuit board. The detachable substrate and the control circuit board are arranged to have an angle between the first surface and the second surface. The energy harvesting module is disposed on the control circuit board. The energy harvesting module is configured to receive the microwave signal and converts the microwave signal into a direct current signal. The energy storage module is coupled to the energy harvesting module. The energy storage module performs an energy storage operation through receiving the direct current signal. The power supply module is coupled to the energy storage module. The display panel is coupled to the power supply module. The power supply module is configured to enable the display panel.

To sum up, the antenna device and the electronic apparatus provided by the embodiments of the invention may enable the detachable substrate with the antenna radiator to be vertically disposed on or be inclined at an angle to be disposed on the control circuit board, such that the antenna radiator may effectively receive the microwave signal and can provide anti-shielding effect capability.

To make the aforementioned and other features and advantages of the invention more comprehensible, several embodiments accompanied with drawings are described in detail as follows.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
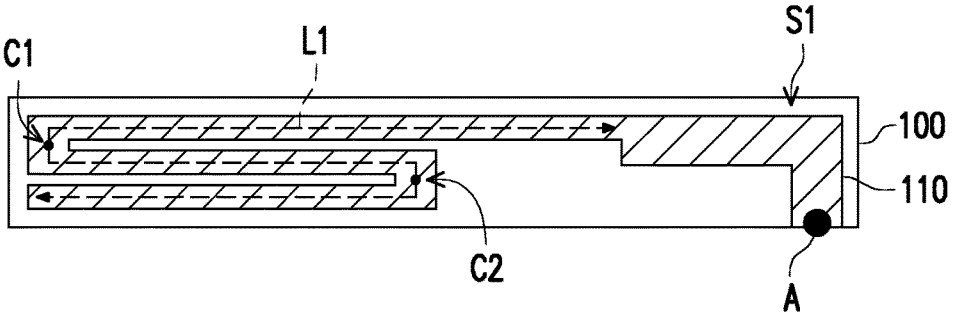
FIG. 1 illustrates a schematic view of an antenna radiator according to an embodiment of the invention.

In order to make the invention more comprehensible, several embodiments of the invention are introduced herein to describe the invention, but the invention is not limited by the embodiments. Suitable combinations among the embodiments are also allowed. Moreover, elements/components/steps with the same reference numerals are used to represent the same or similar parts in the drawings and embodiments.

FIG. 1 illustrates a schematic view of an antenna radiator according to an embodiment of the invention. Referring to FIG. 1, an antenna radiator 110 is disposed on a first surface S1 of a detachable substrate 100. In the present embodiment, the antenna radiator 110 is configured to receive a microwave signal of at least one frequency band through wireless transmission, and a first length L1 of the antenna radiator 110 is determined by a half-wave length of the at least one frequency band received. In the present embodiment, the antenna radiator 110 is, for example, a conductive material made of metal, and the detachable substrate 100 is, for example, a FR-4 substrate, a flexible substrate, or a printed circuit board (PCB) substrate, etc. with a thickness of 0.8 mm. The invention is not limited thereto. Specifically, the first length L1 of the antenna radiator 110 may be determined according to the following formula (1) and formula (2).

$$\lambda_0 = C/f \tag{1}$$

$$L1 = \lambda_0/2 \tag{2}$$

Note that in the foregoing formula (1) and formula (2), C is a velocity of light, f is a center frequency of a frequency band, and $\lambda_0$ is a wavelength of the frequency band in the air. In the present embodiment, the first length L1 of the antenna radiator 110 is determined according to a half-wave length of the frequency band received. Moreover, in an embodiment, if the antenna radiator 110 is adapted to receive microwave signals of a plurality of frequency bands, such that the first length L1 of the antenna radiator 110 may be a sum of each of the half-wave lengths of the frequency bands.

In the present embodiment, the antenna radiator 110 is disposed on the detachable substrate 100, and a size of the detachable substrate 100 may be designed according to different equipment requirements. Therefore, in the present embodiment, the antenna radiator 110 may be shaped and correspondingly disposed according to the size of the detachable substrate 100. That is to say, if a length of the detachable substrate 100 is limited, the antenna radiator 110 may thus include at least one bending point. The antenna radiator 110 may be disposed in a bent manner, such that a length of the antenna radiator 110 required is maintained. For instance, as shown in FIG. 1, as the length of the detachable substrate 100 is limited, the antenna radiator 110 may include bending points C1 and C2, such that, the antenna radiator 110 may be disposed on the detachable substrate 100, and the required length is thus maintained. However, a bending shape of the antenna radiator 110 provided by the embodiments of the invention is not limited to a shape shown in FIG. 1. In an embodiment, the bending shape and a number of the bending points of the antenna radiator 110 may be determined according to the size of the detachable substrate 100.

Figure 2:
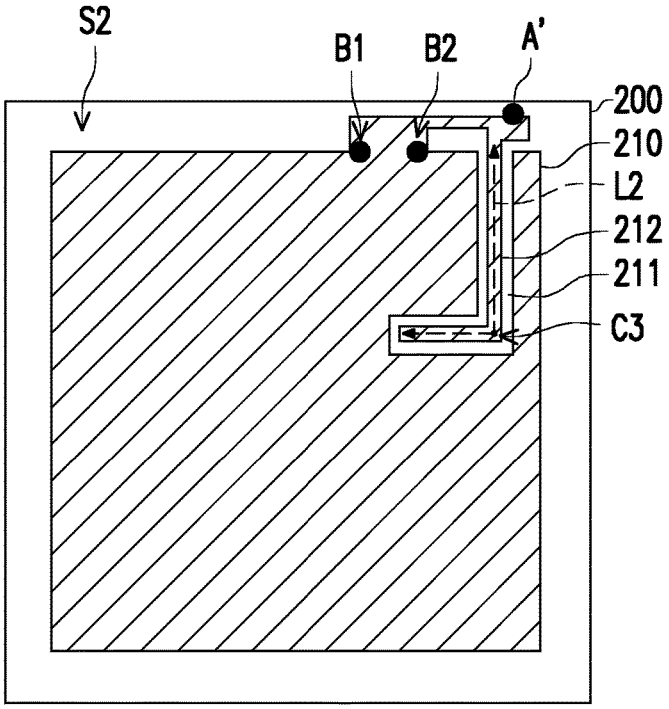
FIG. 2 illustrates a schematic view of a feed line layer according to an embodiment of the invention.

FIG. 2 illustrates a schematic view of a feed line layer according to an embodiment of the invention. Referring to FIG. 2, a feed line layer 210 is disposed on a second surface S2 of a control circuit board 200 in the present embodiment. The feed line layer 210 has a slot structure 211 and a signal feed line 212, and the signal feed line 212 is disposed in the slot structure 211. In the present embodiment, the control circuit board 200 may be a FR-4 substrate, a flexible substrate, or a printed circuit board (PCB) substrate, etc. The invention is not limited thereto. In the present embodiment, the signal feed line 212 has 50 ohm impedance matching, and a second length L2 of the signal feed line 212 is determined by a thickness of the feed line layer 210. That is to say, with 50 ohm impedance matching, the second length L2 of the signal feed line 212 may be determined according to an effective dielectric constant and a thickness of the feed line layer 210, and thus, the invention is not limited thereto.

In the present embodiment, the signal feed line 212 has a bending point C3, and the feed line layer 210 further includes a connection point A' and short-circuit points B1 and B2. The short-circuit points B1 and B2 are configured for grounding. In the present embodiment, the two short-circuit points B1 and B2 and an opening end of the slot structure 211 may be disposed on a same side of the feed line layer 200. In the present embodiment, a position of the bending point C3 of the signal feed line 212 may be correspondingly adjusted according to the frequency band of the microwave signal, such that the signal feed line 212 is able to effectively excite a mode of the frequency band.

Figure 3:
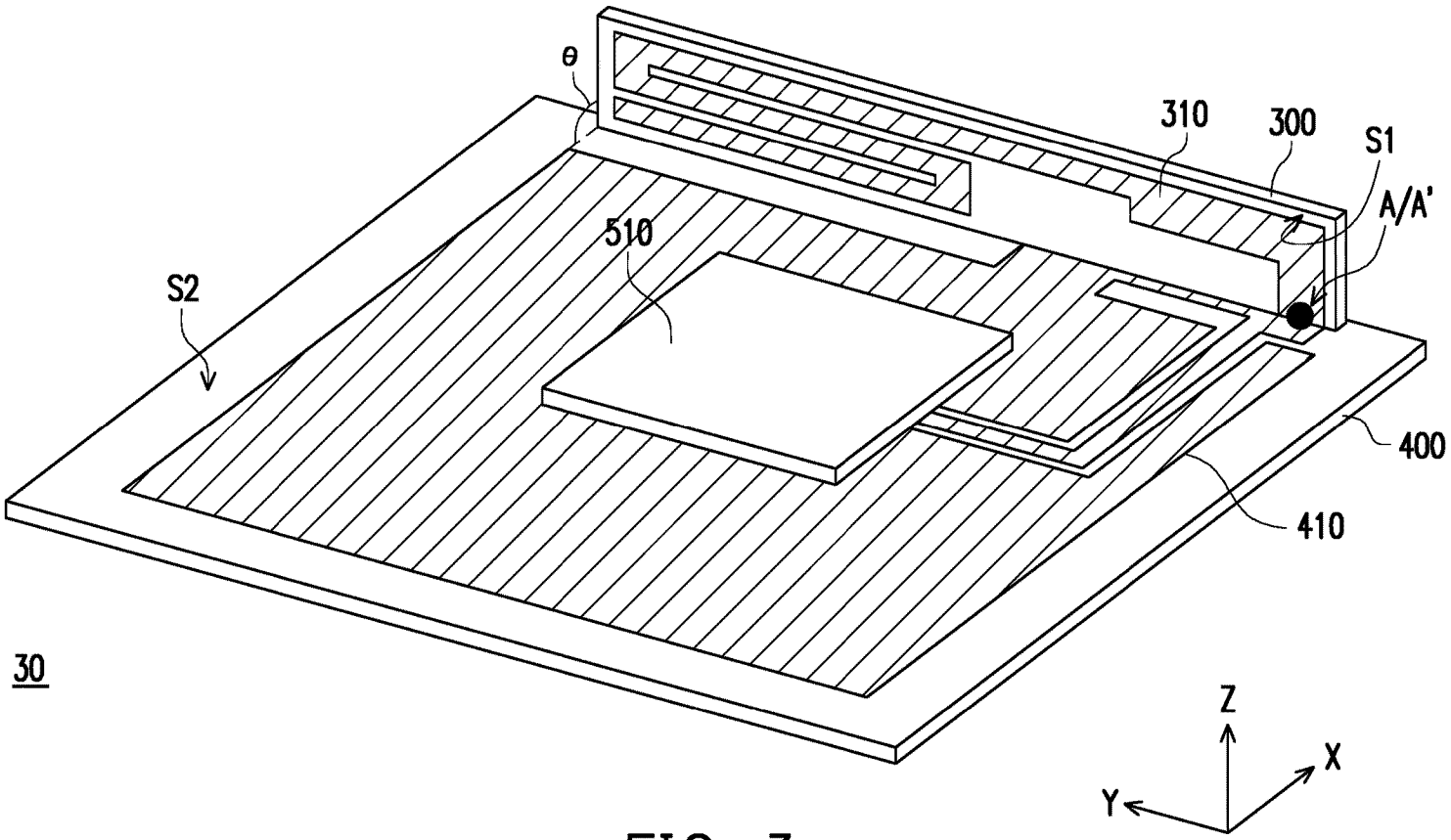
FIG. 3 illustrates a schematic view of an antenna device according to an embodiment of the invention.

FIG. 3 illustrates a schematic view of an antenna device according to an embodiment of the invention. Referring to FIG. 3, an antenna device 30 includes a detachable substrate 300, a control circuit board 400, and an energy harvesting module 510. In the present embodiment, the related structural features and embodiments of the detachable substrate 300 and the control circuit board 400 can be referred to the embodiments of FIG. 1 and FIG. 2, and a relevant description thereof is thus omitted. In the present embodiment, the control circuit board 400 may be disposed on a plane formed by a coordinate axis X and a coordinate axis Y, and the detachable substrate 300 is bonded to the control circuit board 400. In the present embodiment, an antenna radiator 310 is disposed on a first surface S1 of the detachable substrate 300, and a feed line layer 410 is disposed on a second surface S2 of the control circuit board 400. A connection point A of the antenna radiator 310 is connected to the connection point A' of the feed line layer 410. A short-circuit point of the feed line layer 410 is grounded through the detachable substrate 300. In the present embodiment, the detachable substrate 300 and the control circuit board 400 are arranged to have an angle θ between the first surface S1 and the second surface S2. For instance, the angle θ between the first surface S1 and the second surface S2 may be 90 degrees, but the invention is not limited thereto. In the present embodiment, the detachable substrate 300 may be vertically disposed on or be inclined at an angle of θ to be disposed on the control circuit board 400. The angle θ between the first surface S1 and the second surface S2 may be determined according to signal reception requirement or an anti-shielding effect. The detachable substrate 300 and the control circuit board 400 are not limited to be disposed in the manner shown in FIG. 3. As such, in the present embodiment, the antenna radiator 310 may at least be prevented from being affected by a signal shielding effect generated by the control circuit board 400.

In the present embodiment, the antenna radiator 310 is configured to receive a microwave signal of at least one frequency band. Moreover, the feed line layer 410 excites a mode of the at least one frequency band through the slot structure and the signal feed line, such that the antenna device 30 may be operated in the at least one frequency band. In the present embodiment, the energy harvesting module 510 may be disposed on the control circuit board 400 and the feed line layer 410. The energy harvesting module 510 is configured to convert the microwave signal received by the antenna radiator 310 into a direct current signal.

Figure 4:
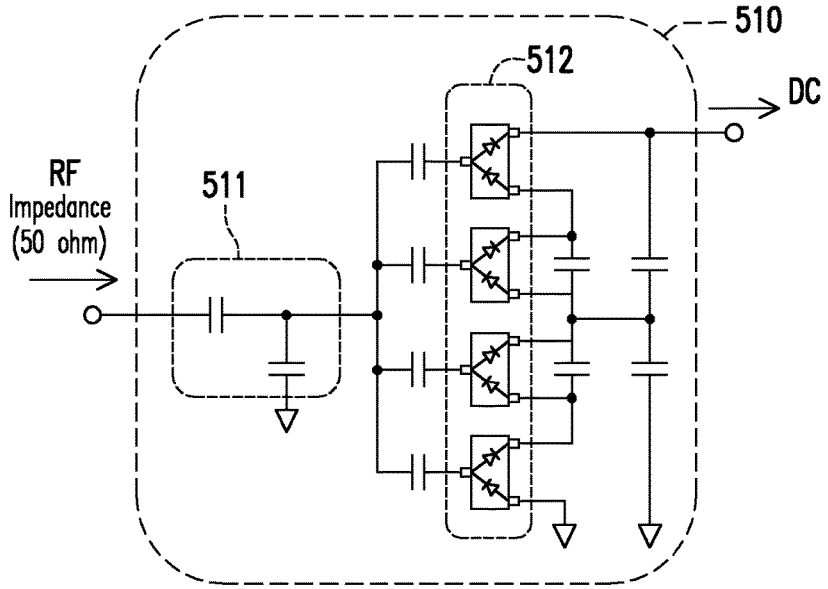
FIG. 4 illustrates a schematic view of an energy harvesting module according to an embodiment of FIG. 3 of the invention.

FIG. 4 illustrates a schematic view of an energy harvesting module according to an embodiment of FIG. 3 of the invention. Referring to FIG. 3 and FIG. 4, the energy harvesting module 510 includes a filter circuit 511 and a rectifier circuit 512. In the present embodiment, the filter circuit 511 may include a plurality of capacitors, and the rectifier circuit 512 may be composed of a plurality of diode elements and capacitors. The filter circuit 511 and the rectifier circuit 512 may be used to convert a microwave signal of a single frequency band or microwave signals of multiple frequency bands into a direct current signal. Specifically, the filter circuit 511 receives a microwave signal RF provided by the antenna radiator 310 first and enables the microwave signal RF having a specific frequency band to pass through so as to be provided to the rectifier circuit 512. Next, the rectifier circuit 512 rectifies and converts the microwave signal RF passing through the filter circuit 511 into a direct current signal DC. The rectifier circuit 512 may, for example, output a direct current voltage of 1 volt to 5 volts. Nevertheless, in the present embodiment, the energy harvesting module 510 of FIG. 4 is merely used to represent an implementable embodiment, but the invention is not limited thereto. In an embodiment, the filter circuit 511 may be an L-shaped, a T-shaped, or a π-shaped filter circuit. Moreover, the rectifier circuit 512 may be composed of a plurality of diode elements and capacitors according to a number of the frequency bands and is not limited to what is shown in FIG. 4.

Figure 5:
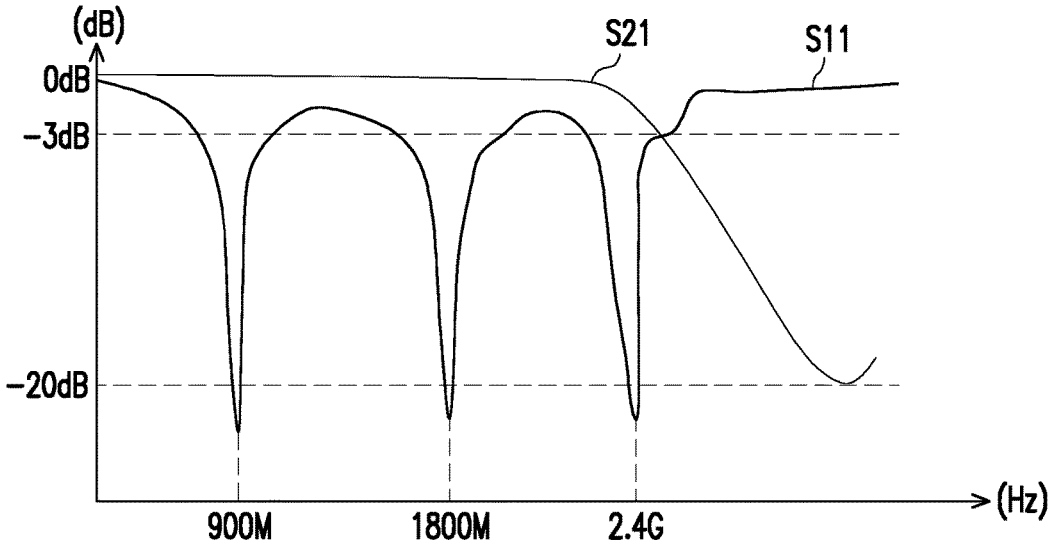
FIG. 5 illustrates an S parameter diagram of a filter circuit according to an embodiment of FIG. 3 of the invention.

Multiple frequency bands are taken for example. FIG. 5 illustrates an S parameter diagram of a filter circuit according to an embodiment of FIG. 3 of the invention. Referring to FIG. 3, FIG. 4, and FIG. 5, in the present embodiment, the antenna device 30 may be a receiving device of microwave signals of multiple frequency bands. That is to say, the antenna radiator 310 may receive and provide the microwave signals RF of multiple frequency bands to the energy harvesting module 510. Therefore, in the present embodiment, the filter circuit 511 may be further disposed in a manner which enables the microwave signals RF of the multiple frequency bands to pass through, and the microwave signals RF of these frequency bands may respectively be converted into direct current (DC) signals through the rectifier circuit 512.

In this exemplary embodiment, the antenna radiator 310 is adapted to be operated in a first frequency band, a second frequency band, and a third frequency band. As such, a first length of the antenna radiator 310 is a sum of respective half-wave lengths of the first frequency band, the second frequency band, and the third frequency band. In this exemplary embodiment, the first frequency band, the second frequency band, and the third frequency band are 900 MHz, 1800 MHz, and 2.4 GHz respectively. The filter circuit 511 may be disposed accordingly to enable the first frequency band, the second frequency band, and the third frequency band to pass through. Moreover, as shown in the S parameter diagram of FIG. 5, losses of a transmission coefficient (S21) of the filter circuit 511 respectively in 900 MHz, 1800 MHz, and 2.4 GHz are close to 0 dB. Moreover, losses of a reflection coefficient (S11) of the filter circuit 511 respectively in 900 MHz, 1800 MHz, and 2.4 GHz are all less than −20 dB. Therefore, the filter circuit 511 of the present embodiment may be correspondingly disposed according to the microwave signals RF of the multiple frequency bands to be received, such that the antenna device 30 may be equipped with the function of effectively harvesting the microwave signals of the multiple frequency bands.

Figure 6:
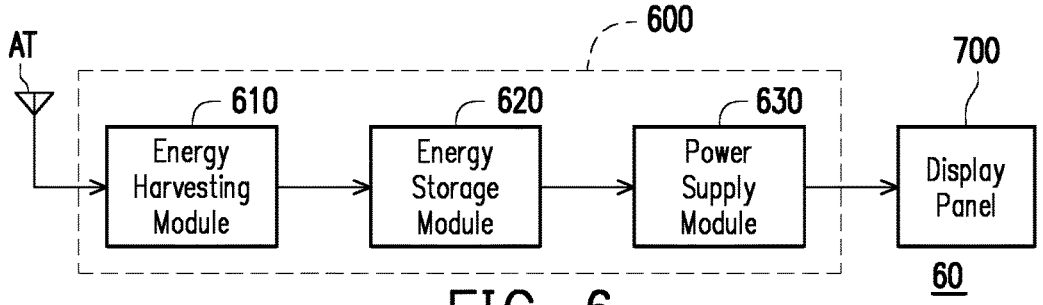
FIG. 6 illustrates a block diagram of an electronic apparatus according to an embodiment of the invention.
Figure 7:
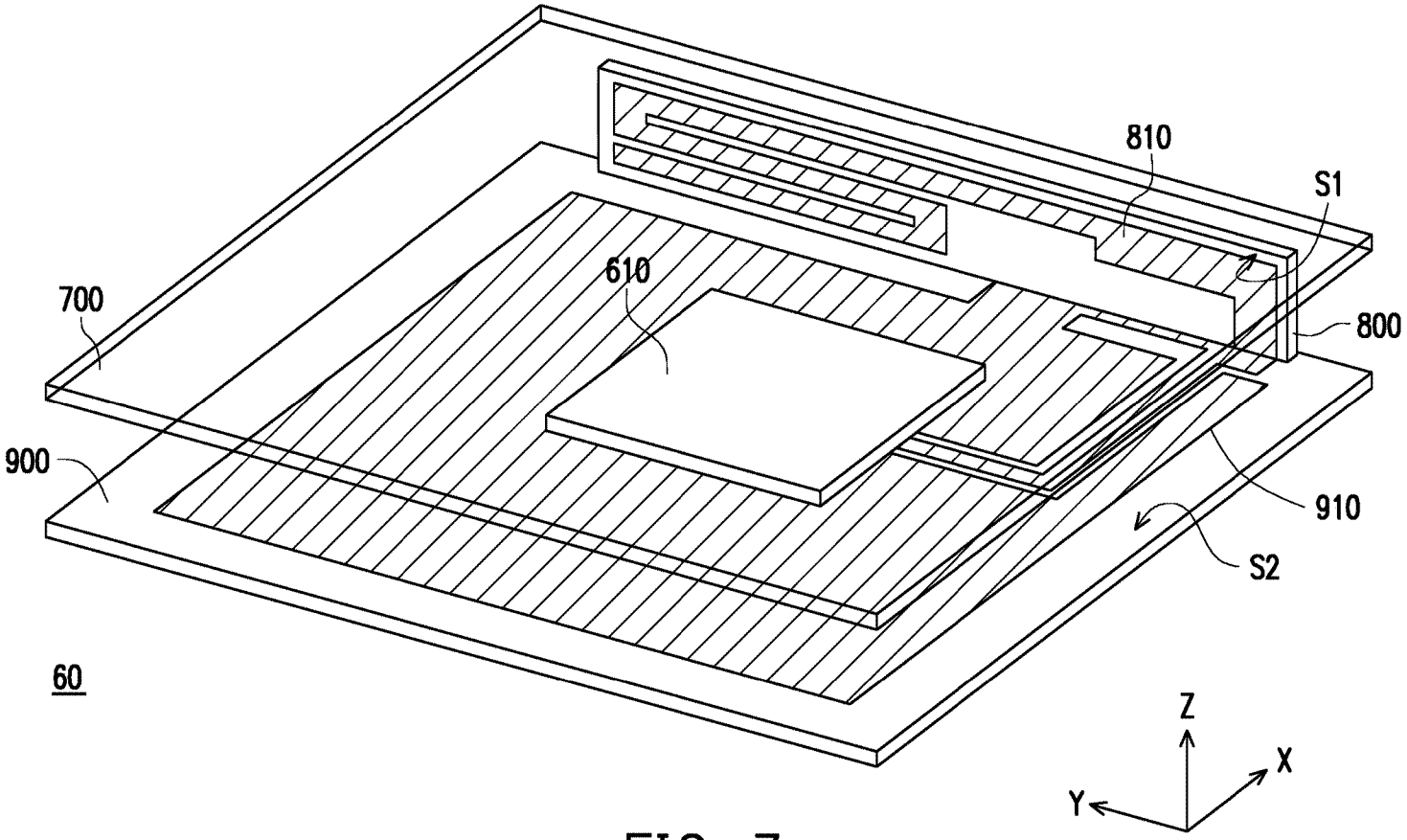
FIG. 7 illustrates a schematic view of an electronic apparatus according to an embodiment of the invention.

FIG. 6 illustrates a block diagram of an electronic apparatus according to an embodiment of the invention. FIG. 7 illustrates a schematic view of an electronic apparatus according to an embodiment of the invention. Referring to FIG. 6 and FIG. 7, in the present embodiment, an electronic apparatus 60 includes an antenna module AT, a control circuit 600, and a display panel 700. The control circuit 600 includes an energy harvesting module 610, and energy storage module 620, and a power supply module 630. In the present embodiment, the antenna module AT refers to an antenna radiator 810 disposed on a detachable substrate 800 and a feed line layer 910 disposed on the control circuit board 900. The related structural features and embodiments of the detachable substrate 800 and the control circuit board 900 can be referred to the embodiments of FIG. 1 to FIG. 5, and a relevant description thereof is thus omitted.

In the present embodiment, the energy harvesting module 610 receives the microwave signal by the antenna module AT, and converts the microwave signal into the direct current signal. The energy storage module 620 is coupled to the energy harvesting module 610 and performs an energy storage operation through receiving the direct current signal. The power supply module 630 is coupled to the energy storage module 620 and the display panel 700. The power supply module 630 is configured to enable the display panel 700 through electrical power stored by the energy storage module 620. Moreover, in an embodiment, the display panel 700 is an electronic paper display (EPD). That is to say, the electronic apparatus 60 of the present embodiment can convert the microwave signal received by the antenna radiator 810 into the direct current signal and perform the energy storage operation through the energy storage module 620. As such, the electronic apparatus 60 of the present embodiment is equipped with a wireless charging function.

In the present embodiment, the energy harvesting module 610 is disposed on the control circuit board 900 and the feed line layer 910. Moreover, the energy harvesting module 610 may be externally coupled to the energy storage module 620 and the power supply module 630. Alternatively, in an embodiment, the energy storage module 620 and the power supply module 630 may also be integrated into the energy harvesting module 610. In the present embodiment, a display surface of the display panel 700 faces one side of a direction of a coordinate axis Z. Moreover, the detachable substrate 800 and the control circuit board 900 may be disposed at a position of a portion of the display panel 700 on the back of the display panel 700, wherein the display panel 700 is parallel to the control circuit board 900. In the present embodiment, the detachable substrate 800 is disposed at one side of the control circuit board 900, and an angle is included between a first surface S1 of the detachable substrate 800 and a second surface S2 of the control circuit board 900. That is to say, the detachable substrate 800 may be vertically disposed between or be inclined at an angle to be disposed between the display panel 700 and the control circuit board 900. As such, the antenna radiator 810 may be effectively prevented from being affected by signal shielding generated by the display panel 700, the control circuit board 900, or other components of the electronic apparatus 60.

In view of the foregoing, the antenna device provided by the embodiments of the invention includes the antenna radiator, the signal feed line, and the energy harvesting module. Therefore, the signal feed line is located in the slot structure of the feed line layer. The antenna radiator is disposed on the detachable substrate, and the feed line layer is disposed on the control circuit board. Therefore, the detachable substrate provided by the embodiments of the invention may be vertically disposed on or be inclined at an angle to be disposed on the control circuit board, and that the antenna radiator may effectively receive the microwave signal in the wireless manner. Moreover, in the embodiments of the invention, the reflection coefficient of the filter circuit of the energy harvesting module in this frequency band is less than −20 dB. Accordingly, the antenna device and the electronic apparatus of the embodiments of the invention may effectively receive the microwave signal for performing wireless charging, and moreover, the antenna radiator is able to provide anti-shielding effect capability.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An antenna device, comprising:

an antenna radiator, disposed on a first surface of a detachable substrate, and configured to receive a microwave signal of at least one frequency band; and a feed line layer, disposed on a second surface of a control circuit board, and the feed line layer comprises a signal feed line, wherein the signal feed line is coupled to the antenna radiator through a connection point, and the connection point is located on one side of the control circuit board, wherein the detachable substrate and the control circuit board are arranged to have an angle between the first surface and the second surface, wherein a first length of the antenna radiator is determined by a half-wave length of the at least one frequency band.

2. The antenna device as claimed in claim 1, wherein the angle is 90 degrees.

3. The antenna device as claimed in claim 1, wherein at least one of the detachable substrate and the control circuit board is a flexible substrate.

4. The antenna device as claimed in claim 1, wherein the antenna radiator is adapted to be at least operated in a first frequency band, a second frequency band, and a third frequency band, and the first length of the antenna radiator is a sum of respective half-wave lengths of the first frequency band, the second frequency band, and the third frequency band.

5. The antenna device as claimed in claim 4, wherein the first frequency band, the second frequency band, and the third frequency band are 900 MHz, 1800 MHz, and 2.4 GHz respectively.

6. The antenna device as claimed in claim 1, wherein the signal feed line is disposed in a slot structure of the feed line layer.

7. The antenna device as claimed in claim 6, wherein the signal feed line has 50 ohm impedance matching, and a second length of the signal feed line is determined by a thickness of the feed line layer.

8. The antenna device as claimed in claim 1, further comprising:

an energy harvesting module, disposed on the control circuit board, and configured to receive the microwave signal, wherein the energy harvesting module comprises:

a filter circuit, configured to receive the microwave signal; and a rectifier circuit, coupled to the filter circuit, and configured to convert the microwave signal passing through the filter circuit into a direct current signal.

9. The antenna device as claimed in claim 8, wherein a reflection coefficient of the filter circuit in the at least one frequency band is less than −20 dB.

10. An electronic apparatus, comprising:

an antenna device, comprising:

an antenna radiator, disposed on a first surface of a detachable substrate, and configured to receive a microwave signal of at least one frequency band; and a feed line layer, disposed on a second surface of a control circuit board, and the feed line layer comprises a signal feed line, wherein the signal feed line is coupled to the antenna radiator through a connection point, and the connection point is located on one side of the control circuit board, wherein the detachable substrate and the control circuit board are arranged to have an angle between the first surface and the second surface;

an energy harvesting module, disposed on the control circuit board, configured to receive the microwave signal, and converting the microwave signal into a direct current signal;

an energy storage module, coupled to the energy harvesting module, and the energy storage module performs an energy storage operation through receiving the direct current signal;

a power supply module coupled to the energy storage module; and a display panel coupled to the power supply module, and the power supply module being configured to enable the display panel.

* * * * *